US011060348B1

(12) United States Patent
Shaw et al.

(10) Patent No.: US 11,060,348 B1
(45) Date of Patent: Jul. 13, 2021

(54) WINDOW BLIND DECORATING KIT

(71) Applicants: Angeleta Shaw, Neptune, NJ (US); Sandra Mitchell, Neptune, NJ (US)

(72) Inventors: Angeleta Shaw, Neptune, NJ (US); Sandra Mitchell, Neptune, NJ (US)

( * ) Notice: Subject to any disclaimer, the term of this patent is extended or adjusted under 35 U.S.C. 154(b) by 329 days.

(21) Appl. No.: 16/299,294

(22) Filed: Mar. 12, 2019

(51) Int. Cl.

| | |
|---|---|
| ***E06B 9/386*** | (2006.01) |
| ***B44D 2/00*** | (2006.01) |
| ***F21V 33/00*** | (2006.01) |
| ***F21S 4/26*** | (2016.01) |
| *F21Y 115/10* | (2016.01) |

(52) U.S. Cl.
CPC ..... *E06B 9/386* (2013.01); *B44D 2/002* (2013.01); *B44D 2/007* (2013.01); *F21S 4/26* (2016.01); *F21V 33/0016* (2013.01); *F21Y 2115/10* (2016.08)

(58) Field of Classification Search
CPC ..... F21S 4/26–28; B44D 2/00–007; E06B 9/24–50; F21V 33/0016
See application file for complete search history.

(56) References Cited

U.S. PATENT DOCUMENTS

| | | | | |
|---|---|---|---|---|
| 5,263,529 | A | 11/1993 | Landis | |
| 5,655,589 | A | 8/1997 | Vartanian | |
| 6,159,582 | A | 12/2000 | Hsu | |
| 6,206,077 | B1 | 3/2001 | Stanfill | |
| D440,096 | S | 4/2001 | Railing | |
| 7,617,857 | B2 | 11/2009 | Froese | |
| 2003/0034134 | A1 | 2/2003 | Saralou | |
| 2003/0213567 | A1 | 11/2003 | Markley | |
| 2006/0288622 | A1 * | 12/2006 | Guard | G11B 33/0472 40/735 |
| 2008/0041533 | A1 * | 2/2008 | Ziegler | E06B 9/386 160/10 |
| 2009/0301665 | A1 * | 12/2009 | Galloway | A47H 13/01 160/84.04 |
| 2011/0076468 | A1 * | 3/2011 | Singer | D06Q 1/10 428/195.1 |
| 2017/0052289 | A1 * | 2/2017 | Boissevain | G02B 5/0284 |

FOREIGN PATENT DOCUMENTS

| | | | | |
|---|---|---|---|---|
| CA | 2671808 | A1 * | 9/2009 | B41J 11/663 |
| GB | 2444785 | | 6/2008 | |
| JP | 2005342356 | A * | 12/2005 | |
| JP | 2009167757 | A * | 7/2009 | |
| JP | 2010270435 | A * | 12/2010 | |
| JP | 2012077503 | A * | 4/2012 | |

* cited by examiner

*Primary Examiner* — Mariceli Santiago
(74) *Attorney, Agent, or Firm* — Kyle A. Fletcher, Esq.

(57) ABSTRACT

The window blind decorating kit is a kit. The window blind decorating kit is configured for use with a Venetian blind. The Venetian blind comprises a plurality of slats. The window blind decorating kit applies an image to the surface formed by the plurality of slats of the Venetian blind when the Venetian blind is positioned to block the passage of light. The window blind decorating kit comprises a stencil, one or more marking compounds, a lamp, and glitter. The one or more marking compounds and the glitter decorate the Venetian blind with a received image. The stencil guides the application of the one or more marking compounds and the glitter to the Venetian blind to form the received image. The lamp illuminates the received image.

20 Claims, 2 Drawing Sheets

WINDOW BLIND DECORATING KIT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including general enclosures of openings in buildings, more specifically, a detail of the lamellae for a lamellar blind. (E06B9/386)

SUMMARY OF INVENTION

The window blind decorating kit is a kit. The window blind decorating kit is configured for use with a Venetian blind. The Venetian blind comprises a plurality of slats. The window blind decorating kit applies an image to the surface formed by the plurality of slats of the Venetian blind when the Venetian blind is positioned to block the passage of light. The window blind decorating kit comprises a stencil, one or more marking compounds, a lamp, and glitter. The one or more marking compounds and the glitter decorate the Venetian blind with a received image. The stencil guides the application of the one or more marking compounds and the glitter to the Venetian blind to form the received image. The lamp illuminates the received image.

These together with additional objects, features and advantages of the window blind decorating kit will be readily apparent to those of ordinary skill in the art upon reading the following detailed description of the presently preferred, but nonetheless illustrative, embodiments when taken in conjunction with the accompanying drawings.

In this respect, before explaining the current embodiments of the window blind decorating kit in detail, it is to be understood that the window blind decorating kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the window blind decorating kit.

It is therefore important that the claims be regarded as including such equivalent construction insofar as they do not depart from the spirit and scope of the window blind decorating kit. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
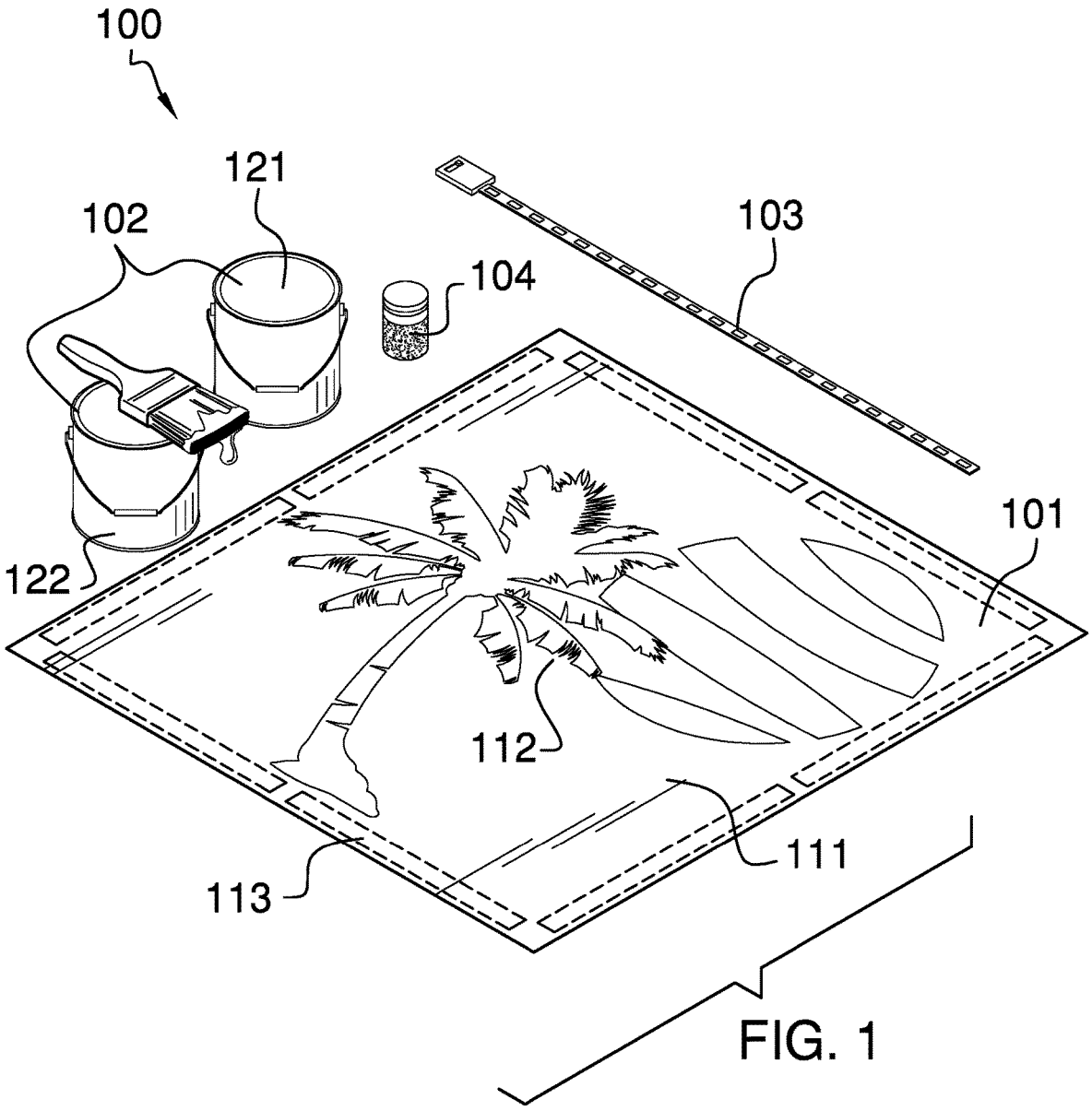
FIG. 1 is a perspective view of an embodiment of the disclosure.
Figure 2:
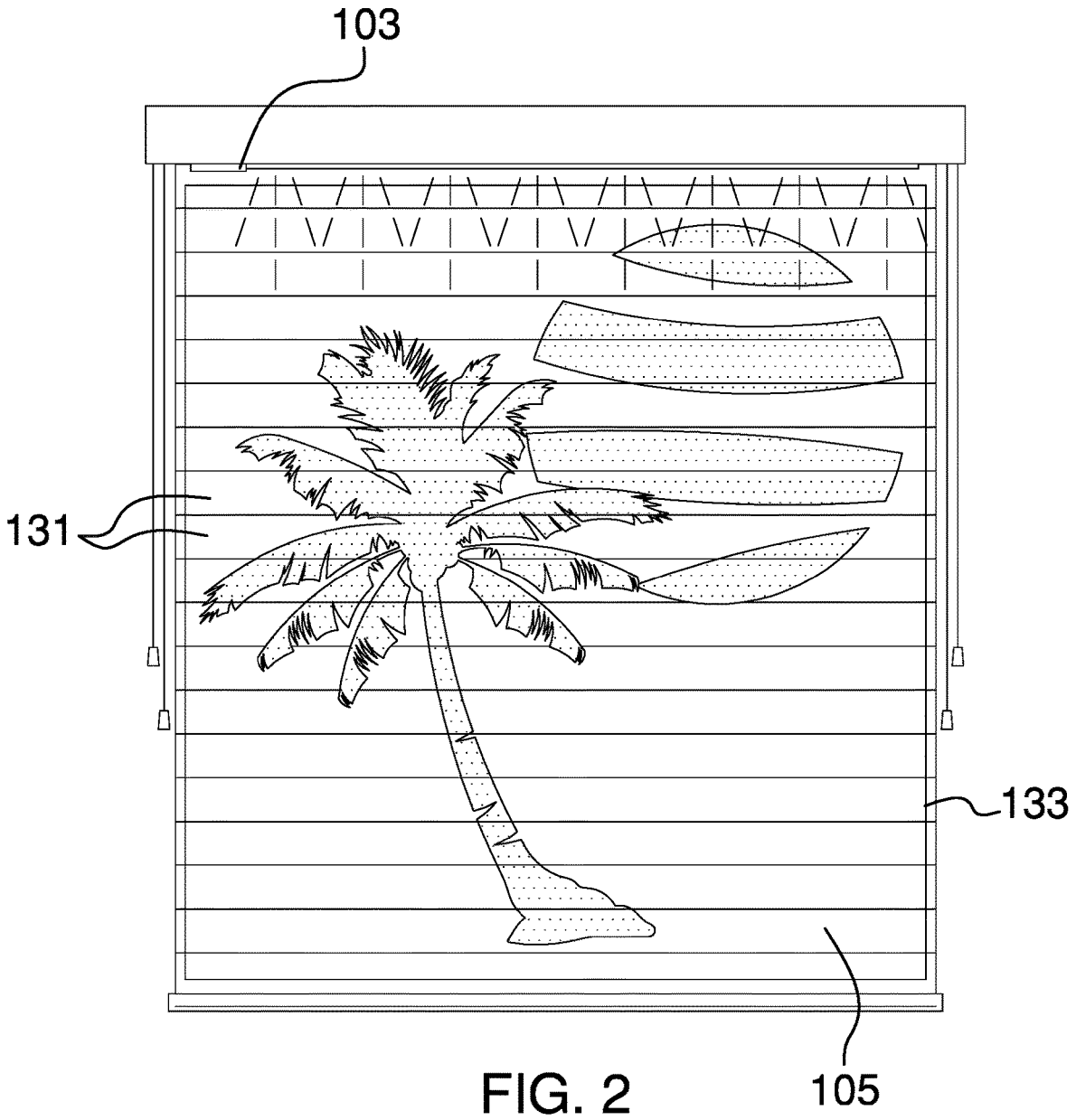
FIG. 2 is an in-use view of an embodiment of the disclosure.

Detailed reference will now be made to one or more potential embodiments of the disclosure, which are illustrated in FIGS. 1 through 2.

The window blind decorating kit 100 (hereinafter invention) is a kit. The invention 100 is configured for use with a Venetian blind 105. The Venetian blind 105 comprises a plurality of slats 131. The invention 100 applies an image to the surface formed by the plurality of slats 131 of the Venetian blind 105 when the Venetian blind 105 is positioned to block the passage of light. The invention 100 comprises a stencil 101, one or more marking compounds 102, a lamp 103, and glitter 104. The one or more marking compounds 102 and the glitter 104 decorate the Venetian blind 105 with a received image 132. The stencil 101 guides the application of the one or more marking compounds 102 and the glitter 104 to the Venetian blind 105 to form the received image 132. The lamp 103 illuminates the received image 132.

The stencil 101 is a sheeting structure. The stencil 101 attaches to the plurality of slats 131 of the Venetian blind 105 when the plurality of slats 131 are in the closed position. By closed position is meant that the orientation of the plurality of slats 131 prevents the passage of light through the Venetian blind 105. The stencil 101 forms a template that guides the application of the received image 132 to the plurality of slats 131 of the Venetian blind 105. The stencil 101 is removed from the Venetian blind 105 after the application of the received image 132. The stencil 101 comprises a sheeting 111, a negative image 112, and a negative border 113.

The sheeting 111 is a plastic sheeting material. The sheeting 111 is a semi-rigid structure with an elastic nature. The sheeting 111 is placed over the plurality of slats 131.

The negative image 112 and the negative border 113 are formed in the sheeting 111. The negative image 112 comprises a plurality of negative spaces that are formed through the faces of the sheeting 111. The negative image 112 forms an overlay on the plurality of slats 131 of the Venetian blind 105. The perimeter of each negative space that forms a portion of the negative image 112 forms the boundaries of each element of the received image 132 applied to the Venetian blind 105. Specifically, the negative spaces formed by the negative image 112 of the stencil 101 form a barrier that protects that underlying regions of the plurality of slats 131 of the Venetian blind 105 from the one or more marking compounds 102 and the glitter 104 as they are applied through the negative image 112 of the stencil 101. The use of a negative image 112 in a stencil 101 is well-known and documented in the decorative arts.

The negative border 113 comprises one or more negative spaces that form a border at the outer perimeter of the received image 132 of the stencil 101. The negative border 113 forms the received border 133 in which is contained the received image 132. The negative border 113 performs a similar function in the stencil 101 as the negative image 112.

The Venetian blind 105 is defined and described elsewhere in this disclosure. The use of a Venetian blind 105 is well-known and documented in the decorative arts. The Venetian blind 105 comprises a plurality of slats 131, a received image 132, and a received border 133.

The plurality of slats 131 are mechanical structures that prevent the passage of light through the Venetian blind 105. The plurality of slats 131 are defined in greater detail elsewhere in this disclosure. The use of a plurality of slats 131 in a Venetian blind 105 is well-known and documented in the decorative arts.

The received image 132 is an image that is formed on the plurality of slats 131 using the stencil 101. The received image 132 is the reverse image of the negative image 112 formed by the stencil 101. The received image 132 is formed using the one or more marking compounds 102 and the glitter 104.

The received border 133 is an image that is formed on the plurality of slats 131 using the stencil 101. The received border 133 is the reverse image of the negative border 113 formed by the stencil 101. The received border 133 is formed using the one or more marking compounds 102 and the glitter 104. The received border 133 forms a perimeter around the received image 132.

Each of the one or more marking compounds 102 is a fluidic substance. Each of the one or more marking compounds 102 is a solution wherein a pigment is a solute that is dissolved or suspended in a solvent. Each of the one or more marking compounds 102 are applied through the stencil 101 onto the plurality of slats 131 while in the closed position to form the received image 132 on the Venetian blind 105. Each of the one or more marking compounds 102 are applied as a fluid.

Each of the one or more marking compounds 102 transitions to a solid pigment structure as the solvent evaporates into the atmosphere. The difference between any two marking compound selected from the one or more marking compounds 102 is the difference in the shade between the two selected marking compounds. The residual solid pigment structure created by side one or more marking compounds 102 forms the received image 132 displayed by the Venetian blind 105. Methods to apply the one or more marking compounds 102 to a surface are well-known and documented in the decorative arts.

In the first potential embodiment of the disclosure, the one or more marking compounds 102 comprises a first paint 121 and a second paint 122. The first paint 121 has a different shade than the second paint 122. The first paint 121 and the second paint 122 are defined in greater detail elsewhere in this disclosure. The application of the first paint 121 and the second paint 122 to a surface such as the plurality of slats 131 is well-known and documented in the decorative arts. The use of a stencil 101 to guide the application of the first paint 121 and the second paint 122 is well-known and documented in the decorative arts.

The lamp 103 is a source of illumination. The lamp 103 is positioned such that the received image 132 is contained within the field of illumination generated by the lamp 103. In the first potential embodiment of the disclosure, the lamp 103 mounts on the Venetian blind 105. In the first potential embodiment of the disclosure, the lamp 103 is an LED rope. The LED rope is defined in greater detail elsewhere in this disclosure.

The glitter 104 is a collection of reflective structures. The reflective structures that form the glitter 104 are randomly distributed such that reflected pattern of the illumination generated by the lamp 103 changes as a function of the position of the viewer relative to the received image 132 on the Venetian blind 105. Methods to apply glitter 104 to a surface are well-known and documented in the decorative arts.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Blind: As used in this disclosure, a blind is a structure that prevents light from passing through a transparent surface into a chamber.

Boundary: As used in this disclosure, a boundary refers to a straight or curved line segment that forms: the portion of the perimeter of a first space; and, 2) the portion of the perimeter of a second space. Stated less formally, the boundary forms the delineation between the first space and the second space. When identifying a boundary within this disclosure, a first space will be said to "be bounded" by one or more additional spaces or objects.

Brush: As used in this disclosure, a brush is a device comprising a plurality of bristles set into a handle or a base that is used for grooming, sweeping, smoothing, scrubbing, or painting.

Closed Position: As used in this disclosure, a closed position refers to a movable barrier structure that is in an orientation that prevents passage through a port or an aperture. The closed position is often referred to as an object being "closed."

Color: As used in this disclosure, a color refers to the visible portion of the spectrum that is reflected off of an object that is exposed to an external source of electromagnetic radiation. A color is often referred to as a shade.

Diode: As used in this disclosure, a diode is a two terminal semiconductor device that allows current flow in only one direction. The two terminals are called the anode and the cathode. Electric current is allowed to pass from the anode to the cathode.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Evaporation: As used in this disclosure, evaporation refers to the phase transition of a compound from a liquid phase to a gas phase.

Field of Illumination: As used in this disclosure, a field of illumination refers to an area illuminated by electromagnetic radiation projected from an electrical device such as a lamp or transmission antenna.

Glitter: As used in this disclosure, glitter refers to the reflection of light from a plurality of randomly oriented surfaces.

Image: As used in this disclosure, an image is an optical representation or reproduction of an indicia or of the appearance of something or someone.

Indicia: As used in this disclosure, the term indicia refers to a set of markings that identify a sentiment.

Kit: As used in this disclosure, a kit is an assembly of a combination of instruments, equipment, or supplies that are dedicated or intended for use in a specific purpose. Depending on the context, a kit may further include the container within which the instruments, equipment, and supplies are stored.

LED: As used in this disclosure, an LED is an acronym for a light emitting diode. A light emitting diode is a diode that is also a light source.

LED Rope: As used in this disclosure, an LED rope is a commercially available lighting device. The LED rope is used LEDs to illuminate a space. The LED rope is a flexible cord structure. The illuminating LEDs are distributed along the span of the length of the cord. The LED rope mounts on a surface. The flexible nature of the LED rope allows the LED rope to bend around corners during installation. The LED rope draws power from the national electric grid. While there are minor technical differences, this definition is intended to include LED rope like products commonly marketed as LED strips.

Light: As used in this disclosure, light refers to electromagnetic radiation that illuminates an area. Illumination is a synonym for light, particularly in cases where a measure of the amount of light in a space is called for.

Negative Space: As used in this disclosure, negative space is a method of defining an object through the use of open or empty space as the definition of the object itself, or, through the use of open or empty space to describe the boundaries of an object.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Overlay: As used in this disclosure, an overlay refers to the placement of a second structure over a first structure such that a portion of the first structure is visible through the second structure.

Paint: As used in this disclosure, when used as a noun the term paint refers to a pigment-based colloid or solution that is applied to a surface as a coating of the surface. When used as a verb, the term paint refers to the application of paint to a surface.

Paintbrush: As used in this disclosure, a paintbrush is a brush that is specifically designed to apply paint to a surface.

Perimeter: As used in this disclosure, a perimeter is one or more curved or straight lines that bounds an enclosed area on a plane or surface. The perimeter of a circle is commonly referred to as a circumference.

Pigment: As used in this disclosure, a pigment is a first material that is used to control the shade of a second material.

Reflection: As used in this disclosure, reflection refers to the change in the direction of a wave as the wave hits the boundary between two media. The direction of the reflected wave remains within the media through which the wave traveled to reach the boundary.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sentiment: As used in this disclosure, a sentiment refers to a symbolic meaning or message that is communicated through the use of an image, potentially including a text-based image. See image and optical character recognition.

Sheeting: As used in this disclosure, a sheeting is a material, such as a paper, textile, a plastic, or a metal foil, in the form of a thin flexible layer or layers.

Slat: As used in this disclosure, a slat is a strip of material that is a component of a larger plurality of slats that forms a barrier. Any first slat either: 1) overlays one or more additional slats selected from the plurality of slats; or, 2) is aligned in some systemic manner with the remaining slats in the plurality of slats. The term slat is commonly used when working with Venetian blinds and fences.

Solution: As used in this disclosure, a solution is a uniform mixture of two or more compounds in a liquid phase. The major component selected of the solution selected from the two or more compounds is called the solvent. The components remaining in the two or more compounds are called the solute.

Stencil: As used in this disclosure, a stencil is a sheeting with one or more negatives spaces formed through it. The stencil is placed as an overlay on a surface. Once overlaid on the surface, the negative spaces of the boundaries allow for the application of paints, inks or other marking substances to be applied to the overlaid surface to create an image on the surface. Stencils configured for repeated use allows for the consistent application of the image on multiple surfaces.

Strip: As used in this disclosure, the term describes a long and narrow object of uniform thickness that appears thin relative to the length of the object. Strips are often rectangular in shape.

Suspension: As used in this disclosure, a suspension is a heterogeneous fluidic mixture containing items that will separate, often through sedimentation, over time.

Venetian Blind: As used in this disclosure, a Venetian blind is a window treatment configured for use with a window. Specifically, the Venetian blind comprises a series of horizontal slats to form a barrier that prevents the passage of light. The typical Venetian blind further comprises a slat tilt mechanism and a ladder mechanism. The slat tilt mechanism adjusts the angle of each horizontal slat relative to the plane of the window such that the amount of light that passes through the Venetian blind can be adjusted. The ladder mechanism allows each horizontal slat to be raised above the window such that the light may pass freely through the window.

Window: As used in this disclosure, a window is an opening formed in a structure that is fitted with glass or other transparent material in a frame to that allows the passage of light through the structure.

With respect to the above description, it is to be realized that the optimum dimensional relationship for the various components of the invention described above and in FIGS. 1 through 2 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A decorative kit comprising:

a stencil, one or more marking compounds, a lamp, and glitter;

wherein the decorative kit is configured for use with a Venetian blind;

wherein the Venetian blind comprises a plurality of slats;

wherein the decorative kit applies an image to the surface formed by the plurality of slats of the Venetian blind when the Venetian blind is positioned to block the passage of light;

wherein the one or more marking compounds and the glitter decorate the Venetian blind with a received image;

wherein the stencil guides the application of the one or more marking compounds and the glitter to the Venetian blind;

wherein the lamp illuminates the received image.

2. The decorative kit according to claim 1 wherein the stencil is a sheeting structure;

wherein the stencil attaches to the plurality of slats of the Venetian blind when the plurality of slats are in the closed position;

wherein by closed position is meant that the orientation of the plurality of slats prevents the passage of light through the Venetian blind.

3. The decorative kit according to claim 2 wherein the stencil forms a template.

4. The decorative kit according to claim 3 wherein the stencil comprises a sheeting, a negative image, and a negative border;

wherein the negative image and the negative border are formed in the sheeting.

5. The decorative kit according to claim 4 wherein the sheeting is a semi-rigid structure with an elastic nature;

wherein the sheeting is placed over the plurality of slats.

6. The decorative kit according to claim 5 wherein the negative image comprises a plurality of negative spaces that are formed through the faces of the sheeting.

7. The decorative kit according to claim 6 wherein the negative border comprises one or more negative spaces that form a border around the negative image.

8. The decorative kit according to claim 7 wherein the negative image forms an overlay on the plurality of slats of the Venetian blind;

wherein the negative spaces formed by the negative image of the stencil form a barrier that protects the underlying regions of the plurality of slats of the Venetian blind from the one or more marking compounds and the glitter as they are applied through the negative image of the stencil.

9. The decorative kit according to claim 8 wherein the plurality of slats are mechanical structures that prevent the passage of light through the Venetian blind.

10. The decorative kit according to claim 9 wherein the Venetian blind further comprises a received image and a received border;

wherein the received image is an image that is formed on the plurality of slats using the stencil;

wherein the received border is an image that is formed on the plurality of slats using the stencil.

11. The decorative kit according to claim 10 wherein the received image is the reverse image of the negative image formed by the stencil;

wherein the received border is the reverse image of the negative border formed by the stencil.

12. The decorative kit according to claim 11 wherein the received border forms a perimeter around the received image.

13. The decorative kit according to claim 12 wherein the received image is formed using the one or more marking compounds and the glitter;

wherein the received border is formed using the one or more marking compounds and the glitter.

14. The decorative kit according to claim 13 wherein each of the one or more marking compounds is a fluidic substance;

wherein each of the one or more marking compounds is a solution wherein a pigment is a solute that maintained in a solvent;

wherein the method of maintenance of the pigment within the solvent is selected from the group consisting of dissolution and suspension.

15. The decorative kit according to claim 14 wherein each of the one or more marking compounds are applied through the stencil onto the plurality of slats while in the closed position.

16. The decorative kit according to claim 15 wherein each of the one or more marking compounds form the received image on the Venetian blind.

17. The decorative kit according to claim 16 wherein each of the one or more marking compounds are applied as a fluid;

wherein each of the one or more marking compounds transitions to a solid pigment structure as the solvent evaporates into the atmosphere.

18. The decorative kit according to claim 17 wherein the difference between any two marking compound selected from the one or more marking compounds is the difference in the shade between the two selected marking compounds.

19. The decorative kit according to claim 18 wherein the glitter is a collection of reflective structures;

wherein the reflective structures that form the glitter are randomly distributed such that reflected pattern of the illumination generated by the lamp changes as a function of the position of the viewer relative to the received image on the Venetian blind.

20. The decorative kit according to claim 19 wherein the lamp is a source of illumination;

wherein the lamp is positioned such that the received image is contained within the field of illumination generated by the lamp;

wherein the lamp mounts on the Venetian blind;

wherein the lamp is an LED rope.

* * * * *